US005849443A

United States Patent [19]

Visser et al.

[11] Patent Number: 5,849,443

[45] Date of Patent: Dec. 15, 1998

[54] METHOD OF MAKING MULTILAYER ELECTROPHOTOGRAPHIC ELEMENTS

[75] Inventors: Susan A. Visser, Rochester; Donald S. Rimai, Webster; Paul M. Borsenberger, Hilton; Suryadevara V. Babu, Potsdam, all of N.Y.

[73] Assignee: Eastman Kodak Company, Rochester, N.Y.

[21] Appl. No.: 23,631

[22] Filed: Feb. 13, 1998

[51] Int. Cl.[6] ..... G03G 13/22; G03G 5/147

[52] U.S. Cl. ..... 430/31; 128/132; 128/133; 128/134

[58] Field of Search ..... 430/31, 128, 132, 430/133, 134

[56] References Cited

U.S. PATENT DOCUMENTS

| | | | |
|---|---|---|---|
| 3,615,414 | 10/1971 | Light | 430/74 |
| 4,082,551 | 4/1978 | Steklenski et al. | 428/420 |
| 4,175,960 | 11/1979 | Berwick et al. | 430/58 |
| 4,602,863 | 7/1986 | Fritz et al. | 430/106.6 |
| 4,882,256 | 11/1989 | Osawa et al. | 430/132 |
| 4,886,722 | 12/1989 | Law et al. | 430/59 |
| 4,895,782 | 1/1990 | Koyama et al. | 430/58 |
| 4,965,156 | 10/1990 | Hotomi et al. | 430/128 |
| 5,002,845 | 3/1991 | Shimura et al. | 430/59 |
| 5,059,502 | 10/1991 | Kojima et al. | 430/66 |
| 5,120,625 | 6/1992 | Yamazaki et al. | 430/66 |
| 5,139,906 | 8/1992 | Doi et al. | 430/58 |
| 5,168,023 | 12/1992 | Mitani et al. | 430/58 |
| 5,213,927 | 5/1993 | Kan et al. | 430/59 |
| 5,288,273 | 2/1994 | Hung et al. | 430/58 |
| 5,330,865 | 7/1994 | Leus et al. | 430/59 |
| 5,525,447 | 6/1996 | Ikuno et al. | 430/67 |
| 5,614,342 | 3/1997 | Molaire et al. | 430/78 |
| 5,656,406 | 8/1997 | Ikuno et al. | 430/67 |

OTHER PUBLICATIONS

W. Sorenson and T. Campbell, *Preparative Methods of Polymer Chemistry*, p. 137, Interscience (1968).

D. S. Weiss, J. R. Cowdery, W. T. Ferrar, and R. H. Young, *Analysis of Electrostatic Latent Image Blurring Caused by Photoreceptor Surface Treatments*, Proceedings of IS&T's Eleventh International Congress on Advances in Non–Impact Printing Technologies–57, 1995.

*Primary Examiner*—Roland Martin
*Attorney, Agent, or Firm*—Doreen M. Wells

[57] ABSTRACT

A method of making a photoconductive element comprises the steps of: a) providing an electrically conductive base and depositing thereon, in any order, photoconductive layers comprising at least one charge transport layer and at least two charge generation layers; b) placing the layers formed in step a) in a reaction chamber with at least one feed gas selected from a hydrocarbon compound and a fluorocarbon compound in their gas phase; and c) decomposing the gas by plasma-enhanced chemical vapor deposition thereby forming on the photoconductive layers an outermost protective layer comprising diamond-like carbon having a fluorine content of between 0 and 65 atomic percent of the protective layer.

9 Claims, No Drawings

METHOD OF MAKING MULTILAYER ELECTROPHOTOGRAPHIC ELEMENTS

CROSS REFERENCE TO RELATED APPLICATIONS

This application is related to the following commonly owned U.S. applications filed on even date herewith:

- U.S. Ser. No. 09/023,596 pending of Visser, Rimai, Borsenberger & Babu titled MULTILAYER PHOTOCONDUCTIVE ELEMENTS HAVING LOW DARK DECAY
- U.S. Ser. No. 09/023,896 pending of Visser, Rimai, Gady, Borsenberger & Babu titled CONTROL OF TRIBOCHARGING OF THE PHOTOCONDUCTOR
- U.S. Ser. No. 09/023,901 pending of Visser, Rimai, Borsenberger & Babu MULTILAYER ELECTROPHOTOGRAPHIC ELEMENTS WITH IMPROVED BLUE SENSITIVITY

FIELD OF THE INVENTION

The present invention relates generally to electrophotography and more particularly to methods of making photoconductive elements and protective layers.

BACKGROUND OF THE INVENTION

Electrophotographic imaging processes and techniques have been extensively described in both the patent and other literature. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a visible record of the electrostatic image.

In order to be useful in an electrophotographic process, a photoconductive element must display good photosensitivity and low residual voltage after exposure. Photosensitivity is a measure of the amount of energy required to discharge the photoconductor from an initial voltage to some predetermined potential. The residual voltage is a measure of the charge remaining on the element after exposing the element. The residual voltage is the minimum voltage to which a photoconductive element can be discharged. A high residual voltage can give rise to a lower potential difference between charged and discharged areas of the element on subsequent imaging cycles. Blurred, fogged, or incomplete images result. Hence, for high process efficiency, high photosensitivity and low residual voltage are desired.

An important group of photoconductive elements used in electro-photographic imaging processes comprises a conductive support in electrical contact with a charge generation layer (CGL) and a charge transport layer (CTL). A CGL is designed primarily for the photogeneration of charge carriers (holes and electrons). A CTL is designed primarily for transportation of the generated charge carriers. The combination of all CGLs and CTLs in a photoconductive element is sometimes referred to as the photoconductive layers. Elements containing a single photoconductive layer that serves the functions of both the CGL and CTL are referred to a single layer elements. Photoconductive elements having one CGL and one CTL are sometimes referred to as dual layer photoconductive elements. Representative patents disclosing methods and materials for making and using such elements include U.S. Pat. Nos. 5,614,342 to Molaire et al, 4,175,960 to Berwick et al and 4,082,551 to Steklenski et al Photoconductive elements containing two or more CGLs, referred to herein as multilayer photoconductive elements, are known. U.S. Pat. No. 5,213,927 to Kan et al discloses photoconductive elements containing a CTL and two CGLs, the first CGL containing a charge-generation material and a first charge-transport material, and the second containing a second charge transport material that is less susceptible to positive-surface charge injection than is the first charge-transport material. Such elements have improved charge uniformity and charge acceptance upon cycling.

One problem associated with photoconductive elements is a phenomenon known as dark decay. Dark decay describes the decrease in the voltage on the element between the time that it is charged by the charging device and the time that it is exposed to image-wise radiation. Dark decay reduces the potential difference between the charged and discharged areas of the photoconductive element after exposure and can result in improper placement of toner on the image. The result is blurred lines, fogging, and other undesirable artifacts in the final image. Particularly in electrophotographic processes that seek to reproduce high quality images at resolutions of 600 dots per inch (dpi) or more, dark decay is a major limiting factor to preparing a useful photoconductive element.

Another problem associated with photoconductive elements of the dual layer or multilayer type is that the lifetime of these elements is less than desired. Physical damage to the photoconductive element incurred during the electrophotographic process, from installation or other service procedures, or from foreign objects falling into the electrophotographic engine during normal use, can significantly reduce the lifetime of the element and will impart defects in the images produced. Such defects occur at random time intervals and cannot be anticipated at normal service intervals.

A further problem is that typically, the photoconductive elements are cycled repeatedly through the electrophotographic process. In each cycle, the photoconductive element is exposed to multiple charging elements, such as the primary, transfer, paper detachment, and pre-clean erase chargers, that are extremely damaging. Exposure to charging elements frequently results in the deposition of chemical species such as nitric acid on the photoconductive element surface, causing a problem called latent image spread (LIS). In severe cases, exposure to the charging elements can also reduce or remove the photosensitivity of the photoconductive element, ending its usefulness in the electrophotographic process. Damage of the photoconductive elements through any of these or other mechanisms caused by exposure of the photoconductive elements to charging elements will be referred to as charger-induced damage.

In order to address the issue of damage to the photoconductive element, protective layers such as sol-gel overcoats are often coated onto the photoconductive element. However, in order to be effective, the charge transport properties of such overcoats must be strictly controlled. If the material is too electrically insulating, it will not permit the photoconductive element to photo-discharge. This will result in poor electrostatic latent image formation. Alternatively, if the layer is too conducting, the electrical charges forming the electrostatic latent image will spread prior to development. This effect, referred to as latent image spread or lateral image spread (LIS), will result in a loss of resolution and blurring of the image. It is particularly problematic with high quality electrophotographic engines producing latent images requiring a resolution of 600 dpi or greater. For commonly used materials such as sol-gels, the electrical conductivity is generally controlled by the addition of ionic charge conducting agents to the sol-gel formulation. However, the resistivity of such materials is highly sensitive to humidity and can be too resistive under some conditions and too conductive under others. Further, the combination of charge conducting agents and commonly used materials such as sol-gels can frequently lead to increased susceptibility to damage from chargers rather than providing the desired protective properties.

It is also important that the charge conduction properties of the entire photoconductive element used in the electrophotographic process be controlled. For example, a highly resistive overcoat may be successfully used with a single layer photoconductive element to improve its dark decay and durability properties. However, if the same overcoat is used with a multilayer photoconductive element, the resulting package may be too insulating to allow adequate photosensitivity and may cause image degradation. Therefore, it is important that the electrical properties of the overcoat layer be appropriately matched to those of the photoconductive element if the resulting photoconductive element is to function adequately for its intended use.

Yet another problem with protective layers is that their adhesion to the photoconductive layers can be less than desired. Specifically, protective layers such as sol-gels tend to be rather thick (approximately 10 micrometers). These tend to crack during use and the cracks frequently propagate through the charge transport and charge generation layers, resulting in a delamination of these layers from the support layer. This is especially problematical in multilayer structures where the thickness of photoconductive element is often greater than in single or dual layer materials and additional interfacial regions can make the element more subject to delamination. Adhesive failure alone can produce image defects, and it can allow scratching or abrasion of the photoconductive element that produces image defects and decreases the element's lifetime.

A further challenge in the design of protective layers is to maintain their flexibility when used on flexible substrates, such as photoconductor elements in a belt configuration. Belts are frequently used in high speed electrophotographic processes. The belts must frequently be bent around rollers or other elements that have a small radius. Thus, the photoconductive element must be able to withstand bending repeatedly over a small bending radius. A thick protective layer will crack or peel away from the photoconductive layers under these circumstances. Ideally, a protective layer less than one micrometer ($\mu$m) thick is needed to circumvent this problem. Thus, it is desirable to provide a protective layer that is as thin as possible. However, it is extremely difficult to develop a protective layer that thin that provides protection from physical damage and does not interfere with any other useful properties of the photoconductive element.

Photoconductive elements containing protective layers are known. Diamond-like carbon (DLC) or amorphous carbon films as protective layers for organic photoconductive elements composed of a single photosensitive layer (single layer photoconductive element) or of a single charge generation layer and a single charge transport layer (dual layer photoconductive elements) are known. Representative patent publications include U.S. Pat. Nos. 5,168,023 and 5,059,502.

The use of diamond-like carbon or amorphous carbon protective layers containing fluorine on single layer or dual layer photoconductive elements for use in an electrotophotographic process has also been disclosed. For example, U.S. Pat. No. 4,965,156 to Hotomi et al. discloses the use of two protective layers on an organic photoconductive element. The first layer is an amorphous carbon layer which includes more than 5 atomic percent fluorine. The second, outermost layer is a similar material except that the fluorine content must be lower than 5 atomic percent. Layer thicknesses disclosed are 0.01 to 4.0 $\mu$m for the first layer and 10 to about 400 angstroms (0.001 to about 0.04 $\mu$m) for the second layer. Hotomi et al. teach that if the fluorine content is above 5 atomic percent in the outermost layer, it causes image fogging. Fogging can be detected by measurements of latent image spread. This invention has disadvantages for practical application. First, it necessitates the deposition of two protective layers of differing composition, increasing the manufacturing complexity and cost of the element. Second, the useful lifetime of the element is limited by the lifetime of the second or outermost protective layer. If the outermost layer is worn away or abraded such that any part of the first protective layer is exposed, Hotomi et al. teach that image fogging will result. Failure to deposit a defect-free second layer has the same result and is extremely likely because of the very low thickness of the layer. A method of providing protection to a photoconductive element which does not cause image fogging would be advantageous.

U.S. Pat. No. 5,525,447 to Ikuno et al. discloses an electrophotographic photoconductor with a surface protective layer formed on the photoconductive layer. The surface protective layer is a multi-layer or graduated layer structure having at least one additive element selected from the group consisting of nitrogen, fluorine, boron, phosphorous, chlorine, bromine, and iodine. The additive element is at a higher concentration near the surface of the protective layer than at the interface between the protective layer and the photoconductive layer. When the additive element is fluorine, the fluorine to carbon atomic ratio (F/C) of 0.001 or less in the vicinity of the photoconductive layer adjacent to the protective layer and of 0.005 or more in the vicinity of the top surface of the protective layer. The layer structure is used to improve adhesion of the protective layer to the photoconductive layer. It is disclosed that adhesion is poor if the multilayer or graduated layer structure is not used. Only single layer and dual layer photoconductive elements are disclosed. Thicknesses of the protective layers in the range of 0.5 to 5 $\mu$m are disclosed.

U.S. Pat. No. 4,882,256 to Osawa et al discloses the use of a hydrogen-containing amorphous carbon overcoat layer containing one or more atoms selected from the group consisting of halogen, oxygen, and nitrogen. Oxygen concentrations in the overcoat layer of 0.1–3% are disclosed. Fluorine concentrations in the overcoat layer of 0.1–23% are disclosed. Single and dual layer photoconductive elements are disclosed.

U.S. patent application Ser. No. 08/639,374 to Visser et al discloses the use of fluorinated diamond-like carbon in the outermost layers of organic photoconductive elements comprising charge transport layers containing arylamine. Fluorine concentrations of 25–65 atomic percent are claimed. Only dual layer photoconductive elements are disclosed. However, the photoconductive elements of Visser '374 exhibit high dark decay. There remains a need for photoconductive elements displaying the advantages inherent in Visser '374 which also have lower dark decay rates.

SUMMARY OF THE INVENTION

The invention, in its broader aspects, provides a method of making a photoconductive element comprising the steps of: a) providing an electrically conductive base and depositing thereon, in any order, photoconductive layers comprising at least one charge transport layer and at least two charge generation layers; b) placing the layers formed in step a) in a reaction chamber with at least one feed gas selected from a hydrocarbon compound and a fluorocarbon compound in their gas phase; and c) decomposing said gas by plasma-enhanced chemical vapor deposition, thereby forming on said photoconductive layers an outermost protective layer comprising diamond-like carbon having a fluorine content of between 0 and 65 atomic percent.

It is an advantageous feature of the invention that the multilayer photoconductive element produced by this method shows the surprising properties of having high sensitivity (low $E_{50\%}$), low residual voltage, and no lateral image spread at low or high relative humidity while simultaneously having lower dark decay than the prior art. Also, in contrast to the prior art, this element additionally and simultaneously has good adhesion of the protective layer to the photoconductive layers and has high resistance to physical and charger-induced damage.

DETAILED DESCRIPTION OF THE INVENTION

The photoconductive element obtained by the method of the present invention, comprises an electrically conductive base, at least one charge transport layer (CTL), two or more charge generation layers (CGLs) and a diamond-like carbon (DLC) protective layer, which is the outermost layer of the element.

The diamond-like carbon (DLC) protective layer is also known as an amorphous carbon layer or a plasma-polymerized amorphous carbon layer. When fluorine is included in the film composition, the protective layer also may be called a fluorinated diamond-like carbon (F-DLC), fluorinated amorphous carbon, or plasma-polymerized fluorocarbon layer. The protective layer is preferably formed by plasma-enhanced chemical vapor deposition (PE-CVD) using an alternating current (AC) or direct current (DC) power source. The AC supply preferably operates in the radio or the microwave frequency range. Selection of PE-CVD processing parameters, such as power source type or frequency, system pressure, feed gas flow rates, inert diluent gas addition, substrate temperature, and reactor configuration, to optimize product properties is well known in the art. The protective layer may comprise a single layer having a uniform composition or one or more multiple layers of non-uniform compositions; however, it is preferred that the protective layer is a single layer having a uniform composition. Further, the protective layer can be formed by a single or multiple passes through the PE-CVD apparatus or reactor, for example; however, it is preferred that the protective layer is formed by a single pass through. PE-CVD reactors are commercially available from, for example, Plasma-Therm, Inc., located in St. Petersburg, Fla.

The protective layer is deposited on the outermost photoconductive layer of the photoconductive element. The outermost photoconductive layer is the layer that is furthest from the electrically conductive base and may be a charge transport layer or a charge generation layer. The outermost photoconductive layer may contain charge transport materials, charge generation materials, mixtures of these materials, or other addenda as described below.

The fluorine content of the protective layer can be between 0 and 65 atomic percent, preferably between 10 and 65 atomic percent, more preferably 25 and 50 atomic percent. A typical measurement of the atomic percent of fluorine in the protective layer is described in detail in Example 1 where X-Ray Photoelectron Spectroscopy (XPS), a well known technique for analyzing the composition of thin films, is employed.

Suitable feed gases for the preparation of the plasma-polymerized protective layer include sources of carbon, such as hydrocarbon compounds. Preferred hydrocarbon compounds include paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; and aromatic hydrocarbons with up to 12 carbon atoms. This list includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tributane, methylheptane, dimethylhexane, trimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, tricyclene, bisabolene, zingiberene, curcumene, humalene, cadinenesesquibenihene, selinene, caryophyllene, santalene, cedrene, camphorene, phyllocladene, podocarprene, mirene, and the like; benzene, toluene, xylene, hemimellitene, pseudocumene, mesitylene, prehnitene, isodurene, durene, pentamethyl-benzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. The hydrocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield a gas phase of the hydrocarbon compound.

By the term "gas phase" as used herein, Applicants refer to a material that has undergone one or more phase transitions to transform the material from its normal solid or liquid phase at room temperature into its gas phase in the reactor. These phase transitions could be induced, for example, by heating the material, by subjecting the material to a reduced pressure that is less than atmospheric, or by heating and reducing the pressure. The phase transitions could include a liquid-to-gas, solid-to-gas, or solid-to-liquid-to-gas transition. In other words, any material that can be made into a gas and that fits into the preceding definition can be used. For example, a liquid that is heated to form a vapor or gas would be useful, as would be a solid that can be heated or sublimed to form a gas. The definition also includes a compound that is already a gas at room temperature and pressure and this is the form most commonly used for this application.

F-DLC protective layers, protective layers containing fluorine, require a source of fluorine, such as fluorocarbon compounds. Suitable fluorocarbon compounds for preparing the protective layer include paraffinic fluorocarbons represented by the formula $C_nF_xH_y$, where n is 1 to 10, preferably 2 to 4, x+y=2n+2, and x is 3 to 2n+2, preferably 2n+2; olefinic fluorocarbons represented by the formula $C_nF_xH_y$, where n is 2to 10, preferably 2 to 4, x+y=2n, and x is 2 to 2n, preferably 2n; acetylenic fluorocarbons represented by $C_nF_xH_y$, where n is 2 to 10 preferably 2, x+y=2n−2, and x is 1 to 2n−2, preferably 2n−2; alkyl metal fluorides; aryl fluorides having from 6 to 14 carbon atoms; alicyclic fluorides, preferably perfluorinated alicyclic compounds, having from 3 to 8 carbon atoms, preferably from 3 to 6 carbon atoms; styrene fluorides; fluorine-substituted silanes; fluorinated ketones; fluorinated aldehydes; and organic substituted compounds thereof. These fluorocarbon feed compounds may have a branched structure. Examples include hexafluoroethane; tetrafluoroethylene; tetrafluoroethane; pentafluoroethane; octafluoropropane; 2H-heptafluoropropane; 1H-heptafluoropropane; hexafluoropropylene; 1,1,1,3,3,3-hexafluoropropane; 1,1,1,2,2,3-hexafluoropropane; 1,1,1,2,3,3-hexafluoropropane; 2-(trifluoromethyl)-1,1,1,3,3,3-hexafluoropropane; 3,3,3-trifluoropropyne; 1,1,1,3,3-pentafluoropropane; 1,1,1,3,3-pentafluoropropene; 1,1,1,2,2-pentafluoropropane; 3,3,3-trifluoropropyne; decafluorobutane; octafluorobutene; hexafluoro-2-butyne; 1,1,1,4,4,4-hexafluorobutane; 1,1,1,4,4,4-hexafluoro-2-butene; perfluoro(t-butyl)acetylene; dodecafluoropentane; decafluoropentene; 3,3,4,4,4-pentafluorobutene-1; perfluoroheptane; perfluoroheptene; perfluorohexane; 1H,1H,2H-perfluorohexene; perfluoro-2,3,5-trimethyl-hexene-2; perfluoro-2,3,5-trimethylhexene-3; perfluoro-2,4,5-trimethylhexene-2; 3,3,4,4,5,5,5-heptafluoro-1-pentene; decafluoropentene; perfluoro-2-methylpentane; perfluoro-2-methyl-2-pentene, perfluoro-4-methyl-2-pentene, hexafluoroacetone, perfluorobenzene, perfluorotoluene, perfluorostyrene, hexafluorosilane, dimethylaluminum fluoride, trimethyltin fluoride, and diethyltin difluoride. The fluorocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield a gas phase of the fluorocarbon compound.

Note that these fluorocarbon compounds can also serve as feed gases for producing non-fluorinated DLC coatings, assuming that changes in process conditions or in post-process treatment are used to ensure that no fluorine remains in the final coatings.

Paraffinic, fully fluorinated fluorocarbons and mixtures thereof are preferred, as are olefinic or acetylinic hydrocarbons or mixtures thereof. Hydrogen is usually incorporated into the films in the form of the hydrogen present in the hydrocarbon feed gas. Pure hydrogen may also be used as an additional feed gas. Mixtures of two or more types of hydrocarbons can be used with one or more fluorocarbon compounds. Mixtures of one or more fluorocarbons, one or more hydrocarbons, and hydrogen can be used.

The presence of hydrogen is not required but may be included. Oxygen may also be incorporated into the films from the feed gas or from atmospheric oxygen gained through reaction with reactive species present in the coating as it is removed from the reactor.

Inert gases such as argon, helium, neon, xeon, or the like optionally may be fed into the reactor during the deposition of the protective layer in order to control the properties of the coating. The use of inert gases to control coating properties is well known to those skilled in the art.

The thickness of the protective layer is preferably between about 0.05 and 0.5 micrometers, more preferably between about 0.15 and 0.35 micrometers.

Each charge transport layer contains, as the active charge transport material, one or more materials, preferably organic materials, capable of accepting and transporting charge carriers generated in the charge generation layer. Charge transport materials generally accept and transport either positive charges (holes) or negative charges (electrons) generated in the charge generation layers. Examples of charge-transport materials that transport holes are arylamines. Suitable arylamines include triphenylamine; tri-p-tolylamine; N-N'-diphenyl-N,N'-bis(3-phenyl)-(1,1'-biphenyl)-4,4'-diamine; 1,1-bis(di-4-tolylaminophenyl) cyclohexane; N,N',N",N'"-tetrakis(4-methylphenyl)-(1,1'-biphenyl)-4,4'-diamine; 4-(4-meth-oxystyryl)-4'4"-dimethoxytriphenyl amine; N,N'-diphenyl-N,N'-di(m-tolyl)-p-benzidine; and mixtures thereof. These and other useful arylamines are disclosed in U.S. Pat. Nos. 5,332,635 to Tanaka, 5,324,605 to Ono et al; and 5,202,207 to Kanemaru et al, incorporated herein by reference. Preferred arylamines are tri-p-tolylamine; and 1,1-bis(di-4-tolylaminophenyl) cyclohexane, and mixtures thereof. Other useful hole transport materials include arylalkanes, hydrazones, and pyrazolines.

Examples of electron transport materials include diphenoquinones, charge-transfer complexes of poly(N-vinylcarbazole):2,4,7-trinitro-9-fluorenone, and 2,4,7-trinitro-9-fluorenone.

The CTL may comprise one or more binder materials and more than one charge transport material. Any additional charge transport material (i.e. in excess of one) can be the same or different material from the first charge transport material. Common binder polymers include polystyrenes, polycarbonates, and polyesters. Useful polyester binders are described in commonly assigned, co-pending application U.S. Ser. No. 08/584,502, now U.S. Pat. No. 5,786,119, titled ELECTRO-PHOTOGRAPHIC ELEMENTS HAVING CHARGE TRANSPORT LAYERS CONTAINING HIGH MOBILITY POLYESTER BINDERS. The polyester binders have the following structural formula:

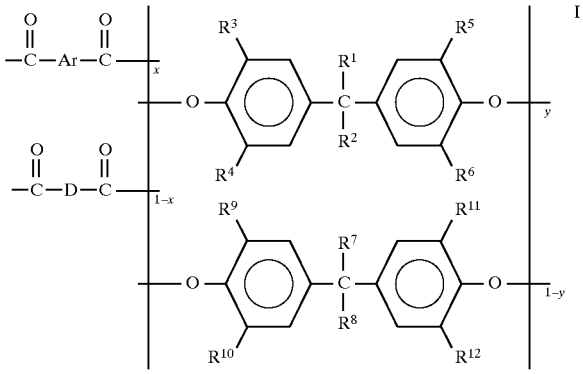

wherein:

x and y represent mole fractions of the unit;

Ar represents phenylene terephthaloyl, isophthaloyl, 5-t-butyl-1,3-phenylene or phenylene indane;

D represents alkylene, linear of branched, or cycloalkylene, having from 4 to about 12 carbons;

$R^1$, $R^2$, $R^7$, and $R^8$ represent H, alkyl having 1 to 4 carbon atoms, cyclohexyl, norbornyl, phenylindanyl, perfluoralkyl having 1 to 4 carbon atoms α,α-dihydrofluoroalkyl having 1 to 4 carbon atoms, or α,α,ω-hydrofluoroalkyl having 1 to 4 carbon atoms; and $R^3$, $R^4$, $R^5$, $R^6$, $R^9$, $R^{10}$, $R^{11}$, and $R^{12}$ represent, H, halogen or alkyl having from 1 to about 6 carbons; x is from 0 to 0.8; and y is from 0 to 1.

The polyester binders can be prepared using well known solution polymerization techniques such as disclosed in W. Sorenson and T. Campbell, *Preparative Methods of Polymer Chemistry*, page 137, Interscience (1968). Schotten-Baumann conditions were employed to prepare the following examples of useful polyester binders: poly(4,4'-isopropylidene bisphenylene terephthalate-co-azelate) (70/30); poly(4,4'-isopropylidene bisphenylene terephthalate-co-isophthalate-co-azelate) (50/25/25); poly(4,4'-isopropylidene bisphenylene-co-4,4'-hexafluoroisopropylidene bisphenylene) (75/25) terephthalate-co-azelate (65/35); poly-(4,4'-isopropylidene bisphenylene-co-4,4'-hexafluroisopropylidene bisphenylene) (50/50) terephthalate-co-azelate (65/35); poly (4,4'-hexafluoroisopropylidene bisphenylene terephthalate-co-azelate) (65/35); poly(hexafluoroisopropylidene bisphenylene terephthalate-co-isophthalate-co-azelate) (50/25/25); and poly(4,4'-isopropylidene bisphenylene isophthalate-co-azelate) (50/50).

The thickness of the charge transport layer may vary. A preferred thickness for the charge transport layer is from about 2 to about 50 $\mu$m dry thickness. A more preferred range is from about 5 to about 30 $\mu$m.

Two or more charge generation layers (CGLs) are present in the photoconductive elements, each comprising a charge generation material, selected from dye polymer aggregates, phthalocyanines, squaraines, perylenes, azo-compounds and trigonal selenium particles and combinations thereof. The CGLs may comprise a binder; however, certain charge generation materials without a binder may be vacuum deposited to form a CGL. Examples of charge generation materials, useful binders and methods of preparing the CGL are disclosed in U.S. Pat. Nos. 4,886,722 to Law et al, 4,895,782 to Koyama et al, 5,330,865 to Leus et al, and 5,614,342 to Molaire et al, incorporated herein by reference. Additional charge generation materials and various sensitizing materials, such as spectral sensitizing dyes and chemical sensitizers may also be incorporated in each charge generation layer.

The charge generation materials in each of the CGLs can be the same or different. They can themselves be sensitizers or can be combined with appropriate sensitizers in order to be sensitive to the same or different wavelengths of radiation. A charge transport material can also be included in one or more of the charge generation layers. Examples of charge transport materials that are useful in charge generation layers include arylamines, particularly triarylamines, and arylalkanes, in particular 1,1-bis(di-4-tolylaminophenyl)-cyclohexane, and 4-N,N-(diethylamino) tetraphenylmethane. The charge transport materials can be included in any or all of the charge generation layers and may be the same or different in each CGL. For example, a triarylamine charge-transport material can be included in a first CGL and a arylalkane charge-transport material in a second CGL. Other pairs or sets of different materials could also be selected. Charge transport materials in the CTL can be the same as or different from any of the charge-transport materials in the CGLs.

Each CGL preferably comprises dye polymer aggregate charge generation material dispersed in an insulating polymeric binder. Examples of useful dye polymer aggregates are disclosed in U.S. Pat. Nos. 4,175,960 to Berwick et al and 3,615,414 to Light, incorporated herein by reference; useful binders are known to a person of ordinary skill in the art. Preferred binders are polycarbonates, for example Lexan™ available from General Electric Company and Makrolon™ available from Mobay, Inc.

Charge generation layers and charge transport layers in elements of the invention can optionally contain other addenda such as leveling agents, surfactants, crosslinking agents, colorants, antioxidants, plasticizers, sensitizers, contrast control agents, and release agents, as is well known in the art.

A useful thickness for each charge generation layer is within the range of from about 0.1 to about 15 $\mu$m dry thickness, preferably from about 0.2 to about 10 $\mu$m.

The charge generation and charge transport layers in the elements of this invention are affixed to an electrically conducting material or to an electrically insulating material coated with a conductive material. In any case, they are affixed to a substrate. A "substrate" can be either flexible or rigid for use in, for example, either web or drum format. A flexible substrate can be either electrically insulating or conducting. Suitable materials include polymers such as poly(ethylene terephthalate), nylon, polycarbonate, poly (vinyl butyral), poly(ethylene), etc., as well as aluminum, stainless steel, ceramics, ceramers, etc. If the substrate material is electrically insulating, it should be coated by a suitable process such as evaporation, sputtering, painting, solvent coating, etc., with a conductive layer such as nickel, copper, gold, aluminum, chromium, or suitable conducting polymers. An electrically conductive substrate material alone or the combination of an insulating substrate and an electrically conductive layer shall be referred to herein as an "electrically conductive base".

Either a charge generation layer or a charge transport layer may be in contact with the protective layer. In some cases, it may be desirable to use one or more intermediate subbing layers or additional charge transport layers between the electrically conductive base and the CTL or CGL, to improve adhesion and/or to act as an electrical barrier layer between the element and the electrically conductive base. Such layers may also be used to improve adhesion between CGL and CTL.

Electrically conductive bases include paper (equilibrated to a relative humidity above 50 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film supports, such as cellulose acetate, polystyrene, poly(ethylene terephthalate), etc. Such conductive materials as chromium, aluminum, or nickel can be vacuum deposited on transparent film substrates in sufficiently thin layers to allow photoconductive elements prepared therewith to be exposed from either side of such elements.

In one method of preparation of the photoconductive elements of the invention, the components of the charge generation layers, or the components of the charge transport layer, including binder and any desired addenda, are dissolved or dispersed together in an organic solvent to form a coating composition which is then solvent coated over an appropriate conductive base. The liquid is then allowed or caused to evaporate from the mixture to form the charge generation or charge transport layers.

Suitable organic solvents include aromatic hydrocarbons such as benzene, toluene, xylene and mesitylene; ketones such as acetone, butanone and 4-methyl-2-pentanone; halogenated hydrocarbons such as dichloromethane, 1,1,2-trichloroethane, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the preferred coating compositions, the optimum ratios of both charge generation material or charge transport material to binder can vary widely, depending on the particular materials employed. In general, useful results are obtained when the total concentration of either charge generation material or charge transport material in the layers is within the range of from about 0.01 to about 90 weight percent based on the dry weight of the layers. In a preferred embodiment of a multilayer photoconductive element of the invention, the coating composition contains from about 0 to about 40 weight percent of charge transport material and from 0.01 to about 80 weight percent of charge generation material based on the weight of the layer.

Another method for deposition of the CTL and CGLs is vacuum evaporation. It is possible to deposit only one of the layers by vacuum evaporation and the rest by coating from a solution or to deposit some fraction of the layers by vacuum evaporation and the rest by coating from a solution. Plasma-deposited charge transport layers are also possible.

The initial image forming step in electrophotography is the creation of an electrostatic latent image on the surface of a photoconductive element. This can be accomplished by charging the element in the dark to a positive or negative potential of several hundreds volts using a charging device, such as a corona or roller charging device, then exposing the photoconductive element in an image-wise fashion to form an image-wise pattern. Absorption of the image exposure creates free electron-hole pairs. Under the influence of the electric field, depending upon the configuration of the CTL and CGLs, the holes migrate toward the conductive base, and the electrons migrate toward the other surface of the photoconductive element, or the electrons migrate toward the conductive base and the holes migrate toward the other surface of the photoconductive element. In such a manner, the surface charge is dissipated in the exposed regions, thus creating an electrostatic charge pattern. Electrophotographic toner can then be deposited onto the electrostatic charge pattern in the development step.

Development of the electrostatic latent image can be accomplished by passing the latent image-bearing photoconductive element over a development station containing a dry powder developer. There are several different types of known development stations; however, the most commonly used station is a so-called magnetic brush station. Although so-called "single component developers" can be used in the development station, most often the developer is comprised of at least two components: magnetic carrier particles and smaller marking toner particles. The carrier particles are attracted to the magnetic brush in the development station and are used to transport the toner particles to the photoconductive element. Moreover, the carrier particles are also comprised of a charge agent which induces a tribocharge on the toner particles. This triboelectrically induced charge on the toner particles causes the particles to become attached to and develop the electrostatic latent image so that a visible image is produced. In addition there can be so called submicrometer diameter "third component" particulate addenda such as silica, latex, strontium titanate, etc., as are commonly used to assist transfer and flow and to stabilize the toner charge present in the developer.

One development station that is particularly useful for producing high quality images is the small particle dry (SPD) development station, as described by Fritz et al in U.S. Pat. No. 4,602,863, the contents of which are incorporated herein by reference. By rotating a magnetic core and using carrier particles having volume weighted diameters of about 30 μm, more uniform development of the electrostatic latent image could be obtained. Furthermore, when combined with small toner particles (i.e., those having volume weighted diameters of less than 9 μm and preferably 6 μm or less, as measured using commercially available devices such as a Coulter Multisizer™, sold by Coulter, Inc.) images having very high quality can be produced. Volume weighted diameter is defined as the mass of each particle times the diameter of a spherical particle of equal mass and density, divided by the total particle mass. It is preferable to use toner particles with mean volume weighted diameters of between 2 and 9 μm and more preferable to use toner particles with mean volume weighted diameters of between 2 and 9 μm which contain a coating of submicrometer particulate addenda such as silica to improve toner flow and transfer.

The resulting image can be transferred to a receiver such as uncoated or coated paper, plastic, or transparency material and rendered permanent with an appropriate fusing or fixing process.

The following examples are presented for a further understanding of the invention.

EXPERIMENTAL

Photoconductive Element A

Photoconductive Element A was a multilayer inverse composite photoconductive element not having a DLC layer and was prepared as follows. First, a CTL solution was prepared by dissolving 57.5 wt % bisphenol-A-polycarbonate Makrolon™ 5705 (Mobay Chemical Company), 2.5 wt % of a copolymer containing 55% ethylene terephthalate and 45% neopentyl terephthalate, 20 wt % of 1,1-bis(di-4-tolylaminophenyl)-cyclohexane, and 20 wt % tri-4-tolylamine to 10 wt % solids in dichloromethane. DC510 phenyl-methyl-substituted siloxane surfactant (Dow Corning) was added at a concentration of 0.01 wt % of the total CTL solution. The CTL solution was coated onto a 7 mil thick nickelized poly(ethylene terephthalate) substrate to give a CTL layer with a dry thickness of 8.5 μm.

A first CGL solution, CGL-I solution, was prepared by dissolving 28.4 wt % bisphenol-A-polycarbonate Makrolon™ 5705 (Mobay Chemical Company), 28.4 wt % bisphenol-A-polycarbonate Lexan™ 145 (General Electric Company, New York), 1.6 wt % 4-(4-dimethylaminophenyl)-2,6-diphenylthiapyrylium hexafluorophosphate, 0.4 wt % 4-(4-dimethylaminophenyl)-2-(4-ethoxyphenyl)6-phenylthiapyrylium fluoroborate, and 39.2 wt % 1,1-bis(di-4-tolylaminophenyl)-cyclohexane, and 2 wt % "seed" into a 70/30 w/w dichloromethane/1,1,2-trichloroethane solvent mixture to give a 10% solids solution. DC510 surfactant was added at a concentration of 0.01 wt % of the total CGL-I solution. The "seed" consisted of 2.3 wt % 4-(4-dimethylaminophenyl)-2,6-diphenylthiapyrylium hexafluorophosphate, 1.5 wt % 4-(4-dimethylaminophenyl)-2-(4-ethyoxyphenyl)-6-phenylthiapyrylium fluoroborate, 67.3 wt % bisphenol-A-polycarbonate Makrolon™ 5705, and 28.9 wt % high molecular weight bisphenol-A-polycarbonate dissolved in a 70/30 w/w solvent mixture of dichloromethane and 1,1,2-trichloroethane. The CGL-I solution was coated on top of the CTL to give a CGL-I layer with a dry thickness of 10 μm.

A second CGL solution, CGII solution, was prepared by dissolving 51.2 wt % bisphenol-A-polycarbonate Makrolon™ 5705, 6.3 wt % 4-(4-di-methylaminophenyl)-2,6-diphenylthiapyrylium hexafluorophosphate, 1.6 wt % 4-(4-dimethylaminophenyl)-2-(4-ethyoxyphenyl)-6-phenylthiapyrylium fluoroborate, 39.0 wt % 4-N,N-(diethylamino)tetraphenylmethane, and 1.9 wt % g "seed" into a 70/30 w/w dichloromethane/1,1,2-trichloroethane solvent mixture to give a 10% solids solution. DC510 surfactant was added at a concentration of 0.01 wt % of the total CGL-II solution. CGL-II solution was coated atop the CGL-I layer to give a CGL-II layer with a dry thickness of 4 $\mu$m.

Photoconductive Element B

Photoconductive Element B was a positively charging, dual layer photoconductive element not having a DLC layer and was prepared as follows. First, the CTL having a p-type charge transport material was coated onto a 7 mil thick nickelized poly(ethylene terephthalate) substrate at a dry thickness of 12 $\mu$m. The CTL mixture comprised 60 wt % poly[4,4'-(2-norbornylidene)bisphenol terephthalate-co-azelate-(60/40)], 19.75 wt % 1,1-bis-[4-(di-4-tolylamino) phenyl]-cyclohexane, 19.5 wt % tri-(4-tolyl)amine, and 0.75 wt % diphenylbis-(4-diethyl-aminophenyl)methane. The CTL mixture was prepared at 10 wt % in a 70/30 (wt/wt) mixture of dichloromethane and methyl acetate. A coating surfactant, DC510, was added at a concentration of 0.024 wt % of the total CTL mixture.

The CGL was coated on the CTL at a dry thickness of 5.8 $\mu$m. The CGL coating mixture comprised 49.5 wt % bisphenol-A-polycarbonate Lexan™ 145, 2.5 wt % [poly (ethylene-co-2,2-dimethylpropylene terephthalate)], 39.25 wt % 1,1-bis-[4-(di-4-tolylamino)phenyl]cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl) -2-(4-ethoxy-phenyl)-6-phenylthiapyrylium fluoroborate, and 2.4 wt % of the aggregate "seed" (a dried paste of the above CGL mixture which had been previously prepared). The CGL mixture was prepared at 9 wt % in an 80/20 (wt/wt) mixture of dichloromethane and 1,1,2-trichloroethane. The coating surfactant DC510 was added at a concentration of 0.01 wt % of the total CGL mixture.

After the CGL and CTL layers had dried the photoconductive element was cut into 5 cm by 5 cm samples which were used in several of the Examples below. Table 4, a reference table showing the composition and nature of the elements tested in Examples 1–20 and Comparative Example A, is provided to assist in comparing the results.

EXAMPLE 1

Fluorinated DLC Layer on Photoconductive Element A

A commercial parallel-plate plasma reactor (Plasma-Therm Model 730) was used for deposition of the fluorinated DLC layer onto Photoconductive Element A. The deposition chamber consisted of two 0.28 meter outer diameter electrodes, a grounded upper electrode and a powered lower electrode. The chamber walls were grounded, and the chamber is 0.38 meter in diameter. Removal of heat from the electrodes was accomplished via a fluid jacket. Four outlet ports (0.04 $m^3$), arranged 90° apart on a 0.33 meter-diameter circle on the lower wall of the reactor, lead the gases to a blower backed by a mechanical pump. A capacitance manometer monitored the chamber pressure that was controlled by an exhaust valve and controller. A 600-W generator delivered radio-frequency (RF) power at 13.56 MHz through an automatic matching network to the reactor. The gases used in the deposition flowed radially outward from the perforated upper electrode in a showerhead configuration in the chamber. The Photoconductive Element A to which the DLC layer was to be applied was adhered to the lower electrode for deposition using double-stick tape. The element was coated at room temperature. The fluorinated DLC layer was deposited on the CGL-II layer of Photoconductive Element A.

The fluorinated DLC (F-DLC) layer was deposited onto the photoconductor by introducing 24 sccm (standard cubic centimeters per minute) hexafluoroethane, 8 sccm acetylene, and 32 sccm argon into the reactor. The reactor pressure and RF power were 13.2 Pa and 100 W, respectively. Deposition time was 3 minutes and 5 seconds.

Thickness of the Fluorinated DLC Layer

Simultaneous deposition of the coating layer on a silicon wafer allowed measurement of coating thickness using UV/VIS reflectometry. The thickness of the coating was measured to be 0.15 $\mu$m.

Composition of the Fluorinated DLC Layer

The composition of the fluorinated DLC layer of Example 1 was analyzed using X-ray photoelectron spectroscopy (XPS). The XPS spectra were obtained on a Physical Electronics 5601 photoelectron spectrometer with monochromatic A1 K$\alpha$ x-rays (1486.6 eV). All spectra were referenced to the C ls peak for neutral (aliphatic) carbon atoms, which was assigned a value of 284.6 eV. Spectra were taken at a 45° electron takeoff angle (ETOA) which corresponds to an analysis depth of about 5 nanometers (nm). Note that XPS is unable to detect hydrogen. The XPS results are presented in Table 1.

Latent Image Spread

Latent image spread (LIS) of the photoconductive element of Example 1 was measured using the method described by D. S. Weiss, J. R. Cowdery, W. T. Ferrar, and R H. Young, *Analysis of Electrostatic Latent Image Blurring Caused by Photoreceptor Surface Treatments*, Proceedings of IS&T's Eleventh International Congress on Advances in Non-Impact Printing Technologies-57, 1995, at ambient conditions (30–40% relative humidity) and at elevated humidity (70% relative humidity) conditions.

The LIS measurement initially produces a square wave pattern in a plot of surface potential versus distance. For a photoconductive element experiencing LIS, as the image spreads, the corners of the square wave become rounded, and the width of the wave broadens. The width of the pattern is determined by drawing tangents to the sides of the wave and measuring the distance between the two tangents at the points where they intersect the baseline drawn between the unimaged portions of the wave. The width of the surface potential wave (image width) is measured as a function of time to determine LIS. The result corresponding to no latent image spread would be an invariant image width as a function of time. Lower image widths and no change in image width as a function of time or of humidity are the desired results. The results of this type of LIS measurement can be correlated with performance of the photoconductive element in an electrophotographic imaging machine.

LIS measurements at low and high ambient relative humidity were performed for the elements of this and all other Examples in this application. No significant latent image spread was observed at either low or high relative humidity in any of the Examples 1–20 below.

Sensitometry testing

Sensitometry testing was performed to measure the photosensitivity (also known simply as sensitivity), residual voltage, and dark decay of the element.

This involved negatively charging the photoconductive element to 500 V in the dark, then exposing the photoconductive element to 680 nm radiation, and monitoring the change in voltage as a function of time. The exposure energy (erg/cm$^2$) is defined as the energy required to discharge the photoconductor from 500 V to 250 V and is denoted as $E_{50}$% ; it is inversely related to the photosensitivity. The residual voltage is the final voltage on the photoconductive element and is denoted as $V_r$. The dark decay of the sample was measured by charging the sample to 500 V and monitoring the decrease in voltage without exposure to light over a 15 second period. Lower exposure energies, residual voltages, and dark decays are more desirable. The results are shown in Table 2.

Scratch Testing

The resistance of the coated photoconductive element of Example 1 to physical damage was determined by scratch testing. A 2.5 $\mu$m diamond stylus was loaded with a 2 g load and dragged across the surface of the sample. The depth of the scratch produced was measured using atomic force microscopy. Smaller scratch depths indicate greater resistance to physical damage. The results appear in Table 3.

Adhesion Testing

Adhesion of the protective layer to the photoconductive layers was evaluated using the crosshatch adhesion test, a standard adhesion test. In this test, two thin lines are cut through the protective layer using a razor blade such that the lines form the shape of an "X." A piece of Scotch type 810 adhesive tape (3M Company, Minneapolis, Minn.) is pressed over the entire "X" -shaped cut to ensure good adhesion at and around the cut. The tape is then pulled off the protective layer rapidly. If any of the protective layer is removed with the tape, then the element fails the test, indicating an adhesion problem between the protective layer and the photoconductive layers. If none of the protective layer is removed, the element passes the adhesion test. This and all other examples of the invention passed the adhesion test.

Resistance to Charger-Induced Damage

A photoconductive element in an electrophotographic process will typically be exposed to a charging element for significantly less than one millisecond per process cycle. Thus, a method to measure changes in a photoconductive element that would result from charging element exposure during many passes through an electrophotographic process cycle is to expose the element to prolonged exposure to a charging element and measure the properties of the treated photoconductive element.

The test used here measures the ability of the photoconductive element to maintain its properties after repeated exposure to charging elements during cycling in the electrophotographic process. This is a test of the resistance of the element to charger-induced damage. The resistance of the coated photoconductive element of Example 1 to charger-induced damage was determined by placing the sample in front of a corona charging unit at 7 kV for 20 minutes, with the DLC protective layer facing the charging unit, and then measuring the photosensitivity as described above. Results of the photosensitivity testing after charging element exposure appear in Table 2.

EXAMPLE 2

Fluorinated DLC Layer on Photoconductive Element A

The photoconductive element of this example was made according to the description in Example 1 except that the fluorinated DLC layer was deposited with the following gas types, and flow rates. Inert argon gas was introduced at a flow rate of 64 sccm, and the reactive gases acetylene and hexafluoroethane were introduced into the reaction chamber at flow rates of 16 sccm each. Deposition time was 4 minutes and 43 seconds.

Thickness of the fluorinated DLC film was 0.2 $\mu$m, determined as described in Example 1.

The composition determination, scratch and sensitometry testing and resistance to charger-induced damage for this example were performed as described in Example 1. The results appear in Tables 1–3.

EXAMPLE 3

Fluorinated DLC Layer on Photoconductive Element A

The photoconductive element of this example was made according to the description in Example 1 except that the fluorinated DLC layer was deposited with the following gas types, and flow rates. Inert argon gas was introduced at a flow rate of 96 sccm, and the reactive gases acetylene and hexafluoroethane were introduced into the reaction chamber at flow rates of 24 sccm and 8 sccm, respectively. Deposition time was 5 minutes and 9 seconds.

Thickness of the fluorinated DLC film was 0.2 $\mu$m, determined as described in Example 1.

The composition determination, scratch and sensitometry testing and resistance to charger-induced damage for this example were performed as described in Example 1. The results appear in Tables 1–3.

EXAMPLE 4

Non-fluorinated DLC Layer on Photoconductive Element A

The photoconductive element of this example was made according to the description in Example 1 except that the DLC layer was deposited with the following gas types and flow rates. Inert argon gas was introduced at a flow rate of 116 sccm, and the reactive gas acetylene was introduced into the reaction chamber at flow rate of 32 sccm. Deposition time was 3 minutes and 24 seconds.

Thickness of the non-fluorinated DLC film was 0.15 82 m, determined as described in Example 1.

The composition determination, scratch and sensitometry testing and resistance to charger-induced damage for this example were performed as described in Example 1. The results appear in Tables 1–3.

EXAMPLE 5

Fluorinated DLC Layer on Photoconductive Element A

The photoconductive element of this example was made according to the description in Example 1 except that the fluorinated DLC layer was deposited with the following gas types, and flow rates. Inert argon gas was introduced at a flow rate of 12.8 sccm, and the reactive gases acetylene and hexafluoroethane were introduced into the reaction chamber at flow rates of 3.2 sccm and 28.8 sccm, respectively. Deposition time was 3 minutes and 37 seconds.

Thickness of the fluorinated DLC film was 0.22 $\mu$m, determined as described in Example 1.

The composition determination, scratch and sensitometry testing and resistance to charger-induced damage for this example were performed as described in Example 1. The results appear in Tables 1–3.

Comparative Example A

Non-Fluorinated DLC Layer on Photoconductive Element B

Photoconductive element B was coated with a non-fluorinated DLC layer as described in Example 4, except that the deposition time was 3 minutes. Sensitometry testing and resistance to charger-induced damage were completed as described in Example 1; results appear in Table 2.

Comparative Example B

Photoconductive Element A without a Protective Layer

Scratch testing for Photoconductive Element A without a protective layer was performed as described in Example 1, with the results shown in Table 2.

EXAMPLE 6

Non-Fluorinated DLC Layer on Photoconductive Element A

Photoconductive element A was coated with a non-fluorinated DLC layer, as described in Example 4, except that the deposition time was 5 minutes.

Thickness of the non-fluorinated DLC film was estimated to be 0.22 $\mu$m by taking the thickness measured for the non-fluorinated DLC layer of Example 4 and multiplying by the ratio of the deposition times for Example 4 and this example.

Sensitometry testing of this example gave $E_{50\%}$ and $V_r$ values comparable to those measured for Example 4. No significant dark decay was observed for this example.

The composition determination, scratch and sensitometry testing for this example were performed as described in Example 1. The results appear in Tables 1 and 3.

EXAMPLE 7

Fluorinated DLC Layer on Photoconductive Element A

Photoconductive element A was coated with a fluorinated DLC layer, as described in Example 3, except that the deposition time was 7 minutes and 35 seconds.

Thickness of the fluorinated DLC film was estimated to be 0.29 $\mu$m by taking the thickness measured for the fluorinated DLC layer of Example 3 and multiplying by the ratio of the deposition times for Example 3 and this example.

Sensitometry testing of this example gave $E_{50\%}$ and $V_r$ values comparable to those measured for Example 3. No significant dark decay was observed for this example.

The composition determination, scratch and sensitometry testing for this example were performed as described in Example 1. The results appear in Tables 1 and 3.

EXAMPLE 8

Fluorinated DLC Layer on Photoconductive Element A

Photoconductive element A was coated with a fluorinated DLC layer, as described in Example 2, except that the deposition time was 6 minutes and 57 seconds.

Thickness of the fluorinated DLC film was estimated to be 0.29 $\mu$m by taking the thickness measured for the fluorinated DLC layer of Example 2 and multiplying by the ratio of the deposition times for Example 2 and this example.

Sensitometry testing of this example gave $E_{50\%}$ and $V_r$ values comparable to those measured for Example 2. No significant dark decay was observed for this example.

The composition determination, scratch and sensitometry testing for this example were performed as described in Example 1. The results appear in Tables 1 and 3.

EXAMPLE 9

Fluorinated DLC Layer on Photoconductive Element A

Photoconductive element A was coated with a fluorinated DLC layer, as described in Example 1, except that the deposition time was 4 minutes and 33 seconds.

Thickness of the fluorinated DLC film was estimated to be 0.22 $\mu$m by taking the thickness measured for the fluorinated DLC layer of Example 1 and multiplying by the ratio of the deposition times for Example 1 and this example.

Sensitometry testing of this example gave $E_{50\%}$ and $V_r$ values comparable to those measured for Example 1. No significant dark decay was observed for this example.

The composition determination, scratch and sensitometry testing for this example were performed as described in Example 1. The results appear in Tables 1 and 3.

EXAMPLE 10

Fluorinated DLC Layer on Photoconductive Element A

Photoconductive element A was coated with a fluorinated DLC layer, as described in Example 5, except that the deposition time was 5 minutes and 19 seconds.

Thickness of the fluorinated DLC film was estimated to be 0.32 $\mu$m by taking the thickness measured for the fluorinated DLC layer of Example 5 and multiplying by the ratio of the deposition times for Example 5 and this example.

Sensitometry testing of this example gave $E_{50\%}$ and $V_r$ values comparable to those measured for Example 5. No significant dark decay was observed for this example.

The composition determination, scratch and sensitometry testing for this example were performed as described in Example 1. The results appear in Tables 1 and 3.

EXAMPLE 11

Non-fluorinated DLC Layer on Photoconductive Element A

Photoconductive element A was coated with a fluorinated DLC layer, as described in Example 4, except that the deposition time was 2 minutes.

Thickness of the non-fluorinated DLC film was estimated to be 0.09 $\mu$m by taking the thickness measured for the fluorinated DLC layer of Example 4 and multiplying by the ratio of the deposition times for Example 4 and this example.

Sensitometry testing of this example gave $E_{50\%}$ and $V_r$ values comparable to those measured for Example 4. No significant dark decay was observed for this example.

The composition determination, scratch and sensitometry testing for this example were performed as described in Example 1. The results appear in Tables 1 and 3.

EXAMPLE 12

Fluorinated DLC Layer on Photoconductive Element A

Photoconductive element A was coated with a fluorinated DLC layer, as described in Example 3, except that the deposition time was 3 minutes and 2 seconds.

Thickness of the fluorinated DLC film was estimated to be 0.12 $\mu$m by taking the thickness measured for the fluorinated DLC layer of Example 3 and multiplying by the ratio of the deposition times for Example 3 and this example.

Sensitometry testing of this example gave $E_{50\%}$ and $V_r$ values comparable to those measured for Example 3. No significant dark decay was observed for this example.

The composition determination, scratch and sensitometry testing for this example were performed as described in Example 1. The results appear in Tables 1 and 3.

EXAMPLE 13

Fluorinated DLC Layer on Photoconductive Element A

Photoconductive element A was coated with a fluorinated DLC layer, as described in Example 2, except that the deposition time was 2 minutes and 47 seconds.

Thickness of the fluorinated DLC film was estimated to be 0.12 $\mu$m by taking the thickness measured for the fluorinated DLC layer of Example 2 and multiplying by the ratio of the deposition times for Example 2 and this example.

Sensitometry testing of this example gave $E_{50\%}$ and $V_r$ values comparable to those measured for Example 2. No significant dark decay was observed for this example.

The composition determination, scratch and sensitometry testing for this example were performed as described in Example 1. The results appear in Tables 1 and 3.

EXAMPLE 14

Fluorinated DLC Layer on Photoconductive Element A

Photoconductive element A was coated with a fluorinated DLC layer, as described in Example 1, except that the deposition time was 1 minute and 49 seconds.

Thickness of the fluorinated DLC film was estimated to be 0.09 $\mu$m by taking the thickness measured for the fluorinated DLC layer of Example 1 and multiplying by the ratio of the deposition times for Example 1 and this example.

Sensitometry testing of this example gave $E_{50\%}$ and $V_r$ values comparable to those measured for Example 1. No significant dark decay was observed for this example.

The composition determination, scratch and sensitometry testing for this example were performed as described in Example 1. The results appear in Tables 1 and 3.

EXAMPLE 15

Fluorinated DLC Layer on Photoconductive Element A

Photoconductive element A was coated with a fluorinated DLC layer, as described in Example 5, except that the deposition time was 2 minutes and 8 seconds.

Thickness of the fluorinated DLC film was estimated to be 0.13 $\mu$m by taking the thickness measured for the fluorinated DLC layer of Example 5 and multiplying by the ratio of the deposition times for Example 5 and this example.

Sensitometry testing of this example gave $E_{50\%}$ and $V_r$ values comparable to those measured for Example 5. No significant dark decay was observed for this example.

The composition determination, scratch and sensitometry testing for this example were performed as described in Example 1. The results appear in Tables 1 and 3.

EXAMPLE 16

Non-Fluorinated DLC Layer on Photoconductive Element A

Photoconductive element A was coated with a non-fluorinated DLC layer, in the manner described in Example 1, except that the reactive feed gas used was 32 sccm ethylene, 116 sccm argon was used as an inert feed gas; and the deposition time was 12 minutes and 25 seconds.

The thickness of the non-fluorinated DLC film was 0.22 $\mu$m, determined as described in Example 1.

Resistance to charger-induced damage for this example was performed as described in Example 1, except that the initial charge on the element in photosensitivity testing was −240V, and the $E_{50\%}$ reported is the energy to discharge from 240 V to 120 V.

The sensitivity of the element of this example to charger-induced damage was determined by placing the sample in front of a corona charging unit at 7 kV for 5 minutes, with the DLC protective layer facing the charging unit, and then measuring the latent image spread (LIS) as described in Example 1. The results show no LIS occurring as a result of charger-induced damage.

The composition determination, scratch and sensitometry testing and resistance to charger-induced damage for this example were performed as described in Example 1. The results appear in Tables 1–3.

EXAMPLE 17

Fluorinated DLC Layer on Photoconductive Element A

Photoconductive element A was coated with a fluorinated DLC layer in the manner described in Example 1, except that the reactive feed gases used were 24 sccm ethylene and 8 sccm hexafluoroethane; 96 sccm argon was used as an inert feed gas; and the deposition time was 8 minutes and 51 seconds.

The thickness of the fluorinated DLC film was 0.2 $\mu$m, determined as described in Example 1.

The composition determination, LIS measurements, and sensitivity testing for this example were performed as described in Example 1. The susceptibility of the element of this example to charger-induced damage was determined as described in Examples 1 and 16. The results show no LIS occurring as a result of charger-induced damage. The other results appear in Tables 1–3.

EXAMPLE 18

Fluorinated DLC Layer on Photoconductive Element A

Photoconductive element A was coated with a fluorinated DLC layer in the manner described in Example 1, except that the reactive feed gases used were 16 sccm ethylene and 16 sccm hexafluoroethane; 64 sccm argon was used as an inert feed gas; and the deposition time was 9 minutes and 27 seconds.

The thickness of the fluorinated DLC film was 0.2 $\mu$m, determined as described in Example 1.

The composition determination, LIS measurements, and sensitivity testing for this example were performed as described in Example 1. The susceptibility of the element of this example to charger-induced damage was determined described in Examples 1 and 16. The results show no LIS occurring as a result of charger-induced damage. The other results appear in Tables 1–3.

EXAMPLE 19

Fluorinated DLC Layer on Photoconductive Element A

Photoconductive element A was coated with a fluorinated DLC layer in the manner described in Example 1, except that the reactive feed gases used were 8 sccm ethylene and 24 sccm hexafluoroethane; 32 sccm argon was used as an inert feed gas; and the deposition time was 10 minutes and 40 seconds.

The thickness of the fluorinated DLC film was 0.24 $\mu$m, determined as described in Example 1.

The composition determination, LIS measurements, and sensitivity testing for this example were performed as described in Example 1. The susceptibility of the element of this example to charger-induced damage was determined as described in Examples 1 and 16. The results show no LIS occurring as a result of charger-induced damage. The other results appear in Tables 1–3.

EXAMPLE 20

Fluorinated DLC Layer on Photoconductive Element A

Photoconductive element A was coated with a fluorinated DLC layer in the manner described in Example 1, except that the reactive feed gases used were 3.2 sccm ethylene and 28.8 sccm hexafluoroethane; 12.8 sccm argon was used as an inert feed gas; and the deposition time was 9 minutes and 56 seconds.

The thickness of the fluorinated DLC film was 0.24 $\mu$m, determined as described in Example 1.

The composition determination, LIS measurements, and sensitivity testing for this example were performed as described in Example 1. The susceptibility of the element of this example to charger-induced damage was determined as described in Examples 1 and 16. The results show no LIS occurring as a result of charger-induced damage. The other results appear in Tables 1–3.

Results of Measurement

The results of LIS measurements demonstrate that DLC and F-DLC protective layers do not cause latent image spread, also known as fogging or image drift, under ambient conditions. Further, even under the more severe test conditions of high humidity testing, the DLC and F-DLC protective layers also do not cause latent image spread.

The scratch testing results demonstrate that the provision of a diamond-like carbon protective layer on the photoconductive element having an electrically conductive base, two or more charge generation layers, and at least one charge transport layer improves the ability of the element to withstand scratching, abrasion, and wear (compare data for Examples to that for Comparative Example B). The adhesion testing results for all Examples demonstrates that the method of this invention also overcomes the adhesion problems observed with other methods.

The data in Table 2 demonstrate that the method of this invention produces photoconductive elements with improved resistance to charger-induced damage. This is demonstrated through both sensitivity and latent image spread measurements after prolonged exposure to a charging element. This contrasts with prior art, exemplified in Comparative Examples A and B which lose all photosensitivity upon prolonged exposure to the charging element; whereas, the photoconductive elements prepared by the method of this invention retain photosensitivity and no LIS.

Any method to improve the resistance to charger-induced damage of photoconductive elements must not only provide this function but must also demonstrate that it provides a photoconductive element with electrophotographic properties that are useful in an electrophotographic device. Particularly relevant electrophotographic properties of a photoconductive element are the photosensitivity ($E_{50\%}$), residual voltage ($V_r$), dark decay, and LIS at low and high ambient humidity conditions.

A significant decrease in dark decay, corresponding to an improvement in electrophotographic properties, is shown in Table 2 for multilayer photoconductive elements containing a protective layer and two charge generation layers (Examples 1–5) compared to a dual layer photoconductive element containing a protective layer and only a single charge generation layer (Comparative Example A).

Discussion of the Results

A photoconductive element having low dark decay can easily be prepared by placing a thick, insulative layer on the outermost surface of the element. However, while this thick layer reduces dark decay, it also substantially and undesirably decreases the sensitivity of the element to the point where it is no longer useful in an electrophotographic process. A thin layer on the outermost surface of the element will not interfere with sensitivity but is unlikely to reduce dark decay. Further, unless the electrical properties of the thin surface layer and the photoconductive layers are appropriately matched, it is likely that the element will display low sensitivity, high residual voltage, high dark decay, LIS, or some combination of these problems. The data in Table 2 for Comparative Example A demonstrates such a case, as the element has high dark decay.

The elements of this invention show the surprising properties of having high sensitivity (low $E_{50\%}$), low residual voltage, and no LIS at low or high relative humidity while simultaneously having lower dark decay than the prior art. This is shown by the data in Table 2. The multilayer photoconductive elements of this invention (Examples 1–5) have sensitivities and residual voltages equivalent to elements in the prior art while also having dark decay rates that are significantly less than the prior art elements (Comparative Example A). It is clear that the combination of the diamond-like carbon protective layer with at least two charge generation layers and at least one charge transport layer gives the surprising result of superior properties to the prior art.

Dark decay rates can be significant because, by lowering the potential on the photoconductive element, color balance, contrast, and maximum density regions can be adversely affected. Moreover, variations in film potential from to site also scale with the dark decay rates. This can cause a mottled looking image.

The significance of lower dark decay rates can be understood by the illustrative example. In some electrophotographic processes, such as a color process, a voltage decrease of 1–2 V can give a change in the color balance of the final image that is noticeable to the eye. A typical period between exposure and development in an electrophotographic apparatus is 10 seconds. Thus, a photoconductive element having a dark decay of 0.1–0.2 V/s lower than another element has significantly and noticeably improved performance compared to that other element. As the data in Table 2 show, all the elements of this invention have significantly improved dark decay compared to the prior art (Comparative Example A).

The LIS and photosensitivity data for all the Examples demonstrate the usefulness of the elements in this invention in the electrophotographic process.

TABLE 1

Composition and Thickness of DLC and F-DLC Protective Layers of Examples 1–20

| Example | Composition C(%) | Composition F(%) | Composition O(%) | Protective layer thickness (μm) |
|---|---|---|---|---|
| 1 | 62.1 | 34.2 | 3.5 | 0.15 |
| 2 | 74.5 | 16.1 | 8.1 | 0.20 |
| 3 | 82.0 | 6.6 | 9.9 | 0.20 |
| 4 | 88.4 | 0.0 | 10.0 | 0.15 |
| 5 | 50.0 | 47.1 | 2.8 | 0.22 |
| 6 | 88.3 | 0.0 | 10.2 | 0.22 |
| 7 | 80.8 | 5.7 | 11.0 | 0.29 |
| 8 | 75.2 | 14.5 | 9.1 | 0.29 |
| 9 | 63.6 | 28.3 | 6.8 | 0.22 |
| 10 | 52.4 | 42.6 | 4.2 | 0.32 |
| 11 | 90.0 | 0.0 | 8.9 | 0.09 |
| 12 | 83.5 | 6.2 | 9.3 | 0.12 |
| 13 | 75.9 | 14.4 | 8.8 | 0.12 |
| 14 | 65.6 | 27.2 | 6.7 | 0.09 |
| 15 | 50.9 | 44.8 | 3.8 | 0.13 |
| 16 | 91.1 | 0.0 | 7.5 | 0.22 |
| 17 | 86.3 | 2.2 | 9.0 | 0.20 |
| 18 | 83.6 | 5.2 | 9.1 | 0.20 |
| 19 | 74.8 | 15.7 | 7.8 | 0.24 |
| 20 | 53.0 | 39.5 | 6.0 | 0.24 |

TABLE 2

Sensitometry Testing Results for Examples 1-5, 16-20, and Comparative Example A

| Example/ Comparative Example | Corona charging element exposure | $E_{50\%}$ (erg/cm$^2$) | $V_r$ (V) | Dark Decay (V/sec) |
|---|---|---|---|---|
| Comp. Ex. A | no | 1.71 | 8 | 2.85 |
| Example 1 | no | 1.67 | 15 | 0.66 |
| Example 2 | no | 1.74 | 15 | 0.66 |
| Example 3 | no | 1.74 | 15 | 1.10 |
| Example 4 | no | 1.66 | 15 | 0.88 |
| Example 5 | no | 1.61 | 16 | 1.10 |
| Example 16 | no | 2.23 | 22 | 1.76 |
| Example 17 | no | 1.83 | 15 | 1.54 |
| Example 18 | no | 1.99 | 20 | 0.88 |
| Example 19 | no | 1.87 | 14 | 2.19 |
| Example 20 | no | 1.83 | 22 | 0.88 |
| Comp. Ex. A | yes | no photodischarge observed | | |
| Example 1 | yes | 1.61 | 16 | 1.1 |
| Example 2 | yes | 1.74 | 15 | 0.66 |
| Example 3 | yes | 1.74 | 15 | 1.1 |
| Example 4 | yes | 1.66 | 15 | 0.88 |
| Example 5 | yes | 1.61 | 16 | 1.1 |
| Example 16 | yes | 2.73 | 28 | |
| Example 17 | yes | 1.86 | 6 | |
| Example 18 | yes | 1.79 | 152 | |
| Example 19 | yes | 2.08 | 73 | |
| Example 20 | yes | 2.08 | 31 | |

TABLE 3

Scratch Testing Results for Examples 1–20 and Comparative Example B

| Example or Comparative Example | Scratch Depth (μm) |
|---|---|
| Example 1 | 0.77 |
| Example 2 | 0.74 |
| Example 3 | 0.67 |
| Example 4 | 0.67 |
| Example 5 | 0.82 |
| Example 6 | 0 |
| Example 7 | 0.74 |
| Example 8 | 0.92 |
| Example 9 | 0.65 |
| Example 10 | 0.64 |
| Example 11 | 0.64 |
| Example 12 | 0.81 |
| Example 13 | 0.70 |
| Example 14 | 0.75 |
| Example 15 | 0.74 |
| Example 16 | 0.74 |
| Example 17 | 0.54 |
| Example 18 | 0.55 |
| Example 19 | 0.62 |
| Example 20 | 0.56 |
| Comparative Example B | 0.97 |

TABLE 4

Reference Table for Comparing the Examples

| Example | Layers | Feed Gas | Thickness μm | DLC |
|---|---|---|---|---|
| Comp A | Dual | 100% acetylene | 0.13 | DLC |
| 1 | Multi | 25% acetylene/75% hexafluoroethane | 0.15 | F-DLC |
| 2 | Multi | 50% acetylene/50% hexafluoroethane | 0.20 | F-DLC |
| 3 | Multi | 75% acetylene/25% hexafluoroethane | 0.20 | F-DLC |
| 4 | Multi | 100% acetylene | 0.15 | none |
| 5 | Multi | 10% acetylene/90% hexafluoroethane | 0.22 | F-DLC |
| 6 | Multi | 100% acetylene | 0.22 | DLC |
| 7 | Multi | 75% acetylene/25% hexafluoroethane | 0.29 | F-DLC |
| 8 | Multi | 50% acetylene/50% hexafluoroethane | 0.29 | F-DLC |
| 9 | Multi | 25% acetylene/75% hexafluoroethane | 0.22 | F-DLC |
| 10 | Multi | 10% acetylene/90% hexafluoroethane | 0.32 | F-DLC |
| 11 | Multi | 100% acetylene | 0.09 | DLC |
| 12 | Multi | 75% acetylene/25% hexafluoroethane | 0.12 | F-DLC |
| 13 | Multi | 50% acetylene/50% hexafluoroethane | 0.12 | F-DLC |
| Comp B | Multi | none | | |
| 14 | Multi | 25% acetylene/75% hexafluoroethane | 0.09 | F-DLC |
| 15 | Multi | 10% acetylene/90% hexafluoroethane | 0.13 | F-DLC |
| 16 | Multi | 100% ethylene | 0.22 | DLC |
| 17 | Multi | 75% ethylene/25% hexafluoroethane | 0.20 | F-DLC |
| 18 | Multi | 50% ethylene/50% hexafluoroethane | 0.20 | F-DLC |
| 19 | Multi | 25% ethylene/75% hexafluoroethane | 0.24 | F-DLC |
| 20 | Multi | 10% ethylene/90% hexafluoroethane | 0.24 | F-DLC |

F-DLC = fluorinated diamond-like carbon
DLC = diamond-like carbon
none = no protective layer The invention has been described in detail with particular reference to certain preferred embodiments thereof, but it will be understood that variations and modifications can be effected within the spirit and scope of the invention.

What is claimed is:

1. A method of making a photoconductive element comprising the steps of:

a) providing an electrically conductive base and depositing thereon, in any order, photoconductive layers comprising at least one charge transport layer and at least two charge generation layers;

b) placing the layers formed in step a) in a reaction chamber with at least one feed gas selected from a hydrocarbon compound and a fluorocarbon compound in their gas phase; and c) decomposing said gas by plasma-enhanced chemical vapor deposition thereby forming on said photoconductive layers an outermost protective layer comprising diamond-like carbon having a fluorine content of between 0 and 65 atomic percent.

2. The method according to claim 1 wherein said hydrocarbon compound is selected from the group consisting of paraffinic hydrocarbons represented by the formula $C_nH_{2n+2}$, where n is 1 to 10; olefinic hydrocarbons represented by formula $C_nH_{2n}$, where n is 2 to 10; acetylenic hydrocarbons represented by $C_nH_{2n-2}$, where n is 2 to 10; alicyclic hydrocarbons; and aromatic hydrocarbons with up to 12 carbon atoms.

3. The method according to claim 1 wherein said fluorocarbon compound is selected from the group consisting of paraffinic fluorocarbons represented by the formula $C_nF_xH_y$, where n is 1 to 10, x+y=2n+2, and x is 3 to 2n+2; olefinic fluorocarbons represented by the formula $C_nF_xH_y$, where n is 2 to 10, x+y=2n, and x is 2 to 2n; acetylenic fluorocarbons represented by $C_nF_xH_y$, where n is 2 to 10, x+y=2n−2, and x is 1 to 2n−2; alkyl metal fluorides; aryl fluorides having from 6 to 14 carbon atoms; alicyclic fluorides having 3 to 8 carbon atoms; styrene fluorides; fluorine-substituted silanes; fluorinated ketones; fluorinated aldehydes.

4. The method of claim 1 wherein an additional element selected from hydrogen and oxygen is present in the reaction chamber.

5. The method of claim 1 wherein an intermediate layer is deposited on the electrically conductive base prior to depositing the photoconductive layers.

6. The element formed by the method of claim 1.

7. A method of reducing dark decay in a photoconductive element comprising the steps of:

providing a photoconductive element having an electrically conductive base, two or more charge generation layers, and at least one charge transport layer; and depositing on said element an outermost protective layer comprising diamond-like carbon having a fluorine content between 0 and 65 atomic percent of the protective layer.

8. A method of reducing dark decay in an electrophotographic process comprising the steps of: a) charging a photoconductive element in the dark, said photoconductive element comprising an electrically conductive base, two or more charge generation layers, at least one charge transport layer, and a protective layer comprising diamond-like carbon having a fluorine content between 0 and 65 atomic percent of the protective layer;

b) exposing said photoconductive element to image-wise radiation to form an electrostatic latent image charge pattern on said protective layer;

c) moving said photoconductive element through a development zone; and d) transporting electrophotographic developer into a development station, through said development zone in contacting developing relation with the electrostatic latent image charge pattern.

9. The method of claim 1 wherein the protective layer is a single layer having uniform composition.

* * * * *